US008630434B2

(12) United States Patent
Rasmussen et al.

(10) Patent No.: US 8,630,434 B2
(45) Date of Patent: Jan. 14, 2014

(54) HEARING DEVICE COMPRISING A MOULD AND AN OUTPUT MODULE

(75) Inventors: Karsten Bo Rasmussen, Smoerum (DK); Svend Oscar Petersen, Smoerum (DK)

(73) Assignee: Oticon A/S, Smorum (DK)

( * ) Notice: Subject to any disclaimer, the term of this patent is extended or adjusted under 35 U.S.C. 154(b) by 1062 days.

(21) Appl. No.: 12/338,567

(22) Filed: Dec. 18, 2008

(65) Prior Publication Data

US 2009/0169039 A1 Jul. 2, 2009

(30) Foreign Application Priority Data

Dec. 27, 2007 (EP) ..... 07124085

(51) Int. Cl.
*H04R 25/00* (2006.01)

(52) U.S. Cl.
USPC ..... 381/325; 381/328

(58) Field of Classification Search
USPC ..... 381/325
See application file for complete search history.

(56) References Cited

U.S. PATENT DOCUMENTS 6,473,513 B1 10/2002 Shennib et al.
7,079,662 B2 * 7/2006 Niederdränk ..... 381/328
2002/0085728 A1 7/2002 Shennib et al.
2005/0123163 A1 * 6/2005 Oliveira et al. ..... 381/380
2007/0071265 A1 * 3/2007 Leedom et al. ..... 381/322
2008/0075310 A1 * 3/2008 Arndt et al. ..... 381/328

FOREIGN PATENT DOCUMENTS

DE 39 27 797 2/1991
DE 39 27 797 A1 2/1991
WO WO 00/76271 A1 12/2000
WO WO 2007/038712 A2 4/2007

OTHER PUBLICATIONS

European Search Report.
European Search Report of EP 07124085 dated Feb. 22, 2008.

* cited by examiner

*Primary Examiner* — Anthony Ho
(74) *Attorney, Agent, or Firm* — Buchanan Ingersoll & Rooney PC

(57) ABSTRACT

A hearing device having a circuitry unit which is adapted for processing sound signals and converting the processed sound signals into corresponding electrical signals. An output module is provided for receiving the electric signals after processing by the circuitry unit. The output module defines an outer surface. At least one venting channel is arranged adjacent to the outer surface of the output module of the hearing device. The hearing device may also have a mold, which is adapted to receive the output module in a through going opening. The at least one venting channel is arranged at the interface between the mold and the output module and advantageously provides a pressure balance in the user's ear canal to minimize occlusion. An ITE-part of a hearing device is furthermore provided.

26 Claims, 6 Drawing Sheets

HEARING DEVICE COMPRISING A MOULD AND AN OUTPUT MODULE

FIELD OF THE INVENTION

The present invention refers to a hearing device comprising an ear mould, and specifically to a hearing device having a venting channel arrangement.

BACKGROUND OF THE INVENTION

Many of today's hearing aids comprising an ear mould or the like include a venting channel to provide suitable ventilation and to avoid the undesired occlusion effect, which reduces comfort for the user. The occlusion effect is caused when a hearing aid (here termed hearing device) or any part thereof is inserted into the user's ear canal and thereby defines a sealed or closed portion of the user's ear canal between the hearing aid or the part thereof and the user's ear drum. For example, in CIC (completely in the ear canal)/ITC (in the canal)/ITE (in the ear) hearing aids a blocking of the ear canal of the user wearing the hearing aid is possible, and this causes a build-up of a low frequency sound pressure, resulting in the above-mentioned and well-known occlusion effect.

This phenomenon can, to a large extent, be suppressed by implementing a venting channel in the hearing aid acoustically connecting the portion of the ear canal of the user sealed (or closed) by the hearing aid or a corresponding part thereof with the outside to obtain a balance of pressure and to raise comfort for the user. An increase in the diameter (effective diameter, cross-sectional area) of the venting channel will reduce the possibility of occurrence of such an occlusion effect, but higher frequencies of sound (corresponding frequency components) will be able to overcome the inertia of the acoustic mass of the venting channel. A venting channel having a relatively large cross sectional area will allow a broader spectrum of sound to escape through it than a venting channel having a relatively smaller cross sectional area. In other words, an otherwise desirable large-diameter venting channel more efficiently propagates the amplified higher frequencies of the ear and might thus create an undesired feedback effect. Preferably, venting channel(s) of a hearing aid has/have to compromise gain with occlusion the best way possible. The dimensions of the venting channel have to be carefully determined, because a relatively large effective diameter will result in less occlusion, but will also reduce the amount of possible gain before feedback is introduced. When a relatively small effective diameter is provided, the amount of gain which is possible in the hearing aid is increased, but the occlusion effect becomes more and more pronounced. It is in this connection advantageous to have a venting channel that would simultaneously permit low frequency sounds to leave the ear canal at a certain time, but also to prevent higher frequency (such as from 2 kHz to 6 kHz) sound from exciting the ear canal and causing feedback which is very uncomfortable for the user of the hearing aid.

Moreover, the provision of a venting channel in a hearing aid, which is effective in view of providing a pressure balance in the user's ear canal and thereby reducing the occlusion effect, requires a certain diameter or certain dimensions to obtain the desired result. This reduces flexibility when manufacturing the hearing aid since a certain space of the hearing aid mould is occupied by the venting channel.

SUMMARY OF THE INVENTION

It is an object of the present invention to provide a hearing device having a venting channel arrangement that can be implemented in a small mould of the hearing device.

According to the present invention, this object is accomplished by a hearing device according to the present invention as set out in the appended claims.

According to a first aspect of the present invention the hearing device comprises: a sound signal input for receiving an electrical signal representing sound waves, an output transducer for converting the processed sound signals into sound waves. The output transducer is part of or forms an output module which defines a closed outer surface. At least one venting channel is arranged adjacent to said outer surface so that sound waves can pass by the output module when inserted in a mould for insertion in a user's ear.

The output transducer is a speaker or earphone (also known as a receiver) for producing sound waves directed to a user's eardrum. In an embodiment, the only electronic component contained in the output module is the receiver (speaker). In an embodiment, the receiver comprises an identification element for identifying the receiver unit (e.g. its type or model or version, as e.g. characterized by its intended technical specifications, such as its input sensitivity and/or max output volume). In an embodiment, the output module does not contain any local energy source (such as a battery).

In an alternative embodiment, the only electronic components contained in the output module are a wireless receiver, possibly comprising an amplifier of the received signal to adapt its level to the receiver (speaker) in question, and the receiver (speaker). In an embodiment, the output module further comprises a microphone. In an embodiment, the output module further comprises a signal processing unit. In an embodiment, the output module further comprises a local power source, e.g. a battery. In an embodiment, all normal electronic functions of a hearing aid are included in the output module (e.g. including an anti feedback system, etc.).

According to a second aspect of the present invention the output module may be, preferably tightly, fit into a mould and the at least one venting channel is arranged between the mould and an outer surface of the output module. The mould is arranged to have an opening with an inner surface, the dimensions and form of outer surface of the output module, the opening and the inner surface of the mould being adapted to allow the output module to be mounted in the opening, preferably tightly, at least over a part of their common spatial extension. In an embodiment, the at least one venting channel is arranged between the inner surface of the mould and an outer surface of the output module, when the output module is mounted in the opening of the mould.

In an embodiment, a venting channel runs substantially linearly along the outer surface of the output module.

In an embodiment, the output module is tightly fit into the opening of the mould. The term 'tightly fit' is in the present context taken to mean that the exchange of air from the enclosed volume between the mould (with the output module properly inserted into an opening of the mould) and the outside environment is controlled by the at least one venting channel. In other words it is anticipated that other parts of the interface between the mould and the output module do not contribute to the exchange of air (i.e. are air-tight or substantially air-tight, e.g. so that less than 20% of the exchange of air between the enclosed volume and the environment can be attributed to other sources than the venting channel(s), such as less than 10%, such as less than 5%, such as less than 2%).

In an embodiment, at least a part of the closed outer surface of the output module forms a longitudinal body or a longitudinal member of a body, at least a part of which being adapted for being mounted in an opening of a mould. In an embodiment, the output module is constituted by a longitudinal body. In an embodiment, the output module comprises or is constituted by a substantially cylindrical body. Alternatively, the output module may have other forms depending on the actual geometrical constraints. In an embodiment, the output module has a conical or a frustoconical shape (e.g. having a cross-sectional area that decreases in a direction of the enclosed volume (when mounted in the ear canal of a user), and the mould having a correspondingly formed opening, thereby creating a good geometry for a tight fit).

In an embodiment, a venting channel extends in the full length of the output module along its longitudinal axis.

Further, a plurality of venting channels may be arranged around the output module extending along a longitudinal axis thereof. The plurality of venting channels can each be provided by a recessed portion on an outer surface of the output module along a longitudinal axis (axial direction) thereof. Alternatively or additionally, one or more venting channels can be formed in the inner surface of the mould facing the outer surface of the output module, when the output module is mounted in the mould in an operational position. Alternatively or additionally, one or more venting channels can be arranged between the outer surface of the output module and the inner surface of the mould by arranging one or more ridges in one of (or both) surfaces, the one or more ridges having a component of extension in an axial direction of the output module. In an embodiment a ridge or channel extends along the outer surface of the output module and/or the inner surface of the mould along a straight line or a helix. In an embodiment, localized protrusions from a surface (either from the inner surface of the mould or the outer surface of the output module or from both) are arranged to fully or partially fix the output module in the opening of the mould and at the same time allow a certain ventilation.

The axial length of the at least one venting channel may be shorter than the axial length of the output module, and preferably the plurality of venting channels can be evenly distributed around the output module in the circumferential direction thereof.

Moreover, according to a third aspect of the present invention, the at least one venting channel may be formed by a recessed portion of the output module extending in the circumferential direction of the outer surface of the output module, and the at least one venting channel may be defined by the mould and a recessed portion in the output module extending in the circumferential direction of the surface of the output module. Preferably a length of the at least one venting channel in a longitudinal axis of the output module may be greater than the thickness of the mould the output module is inserted in (the 'thickness' of the mould being taken in the same longitudinal direction as the longitudinal axis of the output module). Preferably the recessed portion of the outer surface of the output module, the opening and the inner surface of the mould are arranged to provide a venting volume between the inner and outer surfaces, when the output module is mounted in the mould in an operational position.

In general a venting channel is a tubular opening comprising air to provide a good path for aligning the pressure between the enclosed volume and the open side of the mould. However, the at least one venting channel may at least be partly filled with a filler material (e.g. a porous material) to further control the sound propagation properties of the vent. Preferably the filler material can replaceably be inserted in the at least one venting channel. An advantage of the present invention is that such filler material can be conveniently replaced from time to time according to need (due to introduction of impurities, e.g. from serumen), because the vents can be made accessible from the surface of the output module (and/or from the inner surface of the mould opening). In a prior art solution with a distributed vent comprising a multitude of smaller vent cross-sections formed as through going tubes, such replacement is more complex and at times virtually impossible.

The plurality of venting channels leads to a compact and space-saving arrangement of the hearing device. For a given optimal cross-sectional area of one tubular vent, the corresponding cross-sectional area distributed on a number of (necessarily smaller) vent channels provides substantially the same effect at relatively low frequencies (e.g. lower than 2 kHz), but such an arrangement has a larger acoustical attenuation at relatively higher frequencies (e.g. larger than 2 kHz). The insertion of a porous material into the venting channels (over a part or all of the longitudinal extension of the vent) provides an additional possibility to control the acoustic attenuation of a venting channel of a given cross-sectional area and longitudinal extension. In an embodiment, a specific cross-sectional area of a single, air-filled tubular vent to provide an intended reduction of the occlusion effect is determined (for a given ear canal and enclosed volume). By design of a 'distributed' vent with the same (total) cross-sectional area, the resulting effect on occlusion is maintained (mainly determined by the low-frequency part of the signal), but with an increased feedback margin at higher frequencies (e.g. >2 kHz) due to the increased attenuation at these frequencies. By using a number of relatively smaller vents (with or without porous damping material in some or all of the vents over a part or its full length), and placing the vents close to the receiver outlet in the ear (as is ensured by the present construction of the output module and the location of the venting channels at the interface between the output module and the mould), a well-balanced condition is provided resulting in an intended reduction of the occlusion effect and an improved feed-back condition (reduced feedback).

The cross-sectional shape of an individual venting channel can have any appropriate form, e.g. rectangular (such as square) or elliptical (such as circular) of triangular (e.g. a groove). Typically, the cross-sectional shapes of the number of vents will be identical. They may however be different, e.g. depending on the needed attenuation, particular geometrical constraints, etc. In an embodiment, the cross-sectional shape of a vent is identical over its longitudinal extension. This need not be the case, however. In an embodiment, the cross-sectional form and/or area changes along the length of the vent, e.g. increasing from one end to the other. In an embodiment, the vent has a larger cross-sectional area at the end facing the enclosed volume (cf. B in FIG. 1) than at the end facing the outside (cf. A in FIG. 1), thereby providing an improved 'collection' of sound vibrations in the enclosed volume.

In a further aspect, an ear-located part of a hearing device is provided, the ear-located part comprising a) a mould for being inserted in a user's ear canal, the mould being arranged to have an opening with an inner surface, and b) an output module comprising a receiver for providing an acoustic output and being enclosed in a housing having an outer surface, and wherein the dimensions and form of the outer surface of the output module, the opening and the inner surface of the mould being adapted to allow the output module to be mounted in the opening, at least over a part of their common spatial extension, and wherein at least one venting channel is arranged between the inner surface of the mould and an outer surface of the output module. In an embodiment, the input transducer (input unit) and the signal processing unit (control unit) are located in the mould.

It is intended that the features described above for a hearing device, in the detailed description and in the claims—where appropriate—can be freely combined with the ear-located part of a hearing aid.

In a further aspect, a hearing device is provided, the hearing device comprising a) a NITE-part adapted to be located at or behind the ear or other places on the body, b) an ITE-part adapted for being at least partially located in the ear canal of a user, the hearing device comprising an input transducer for converting an input sound to an electrical input signal, a signal processing unit for providing a processed output signal applying a frequency dependent gain to the electric input signal according to a user's needs and an output transducer for converting the processed output signal to an output sound for being presented to the user. The ITE-part comprises an ear-located part of a hearing device as described above. The ear-located part (and thus the ITE-part) comprises a mould and an output module. In an embodiment, the input transducer and the signal processing unit are located in the NITE-part and the output transducer is located in the output module. In an embodiment, the only electronic component contained in the output module is the receiver (speaker). In an embodiment, the only electronic components contained in the output module are a wireless receiver, possibly comprising an amplifier of the received signal to adapt its level to the receiver (speaker) in question, and the receiver (speaker). In an embodiment, the NITE-part is a BTE part adapted for being located at or behind the ear (pinna). In an embodiment, the NITE part is a body worn part, e.g. worn around the neck or, in a pocket or the like.

The foregoing and other objects, features and advantages of the present invention will become more apparent from the following detail the description in conjunction with the corresponding drawings referring to embodiments and developments of the present invention.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present. Furthermore, "connected" or "coupled" as used herein may include wirelessly connected or coupled. As used herein, the term "and/or" includes any and all combinations of one or more of the associated listed items.

BRIEF DESCRIPTION OF THE DRAWINGS

The drawings according to the present invention show in

The figures are schematic and simplified for clarity, and they just show details which are essential to the understanding of the invention, while other details are left out. Throughout, the same reference numerals are used for identical or corresponding parts.

DETAILED DESCRIPTION OF EMBODIMENTS

A hearing device according to the present invention is typically capable of being body worn. In an embodiment, an input transducer and the output transducer are located in the same physical body and located in the ear canal when in an operational state. In a particular embodiment, the hearing device comprises at least two physically separate bodies, which are capable of being in communication with each other by wired or wireless transmission (be it acoustic, ultrasonic, electrical of optical). In an embodiment, an input transducer is located in a first body and the output transducer is located in a second body (here in the output module mounted in a mould located in the ear canal of a user). In an embodiment, the hearing device comprises more than one input transducer. The term 'two physically separate bodies' is in the present context taken to mean two bodies that have separate physical housings, possibly not mechanically connected or, alternatively, essentially only connected by one or more guides for acoustical, electrical or optical propagation of signals.

First Embodiment

Figure 1:
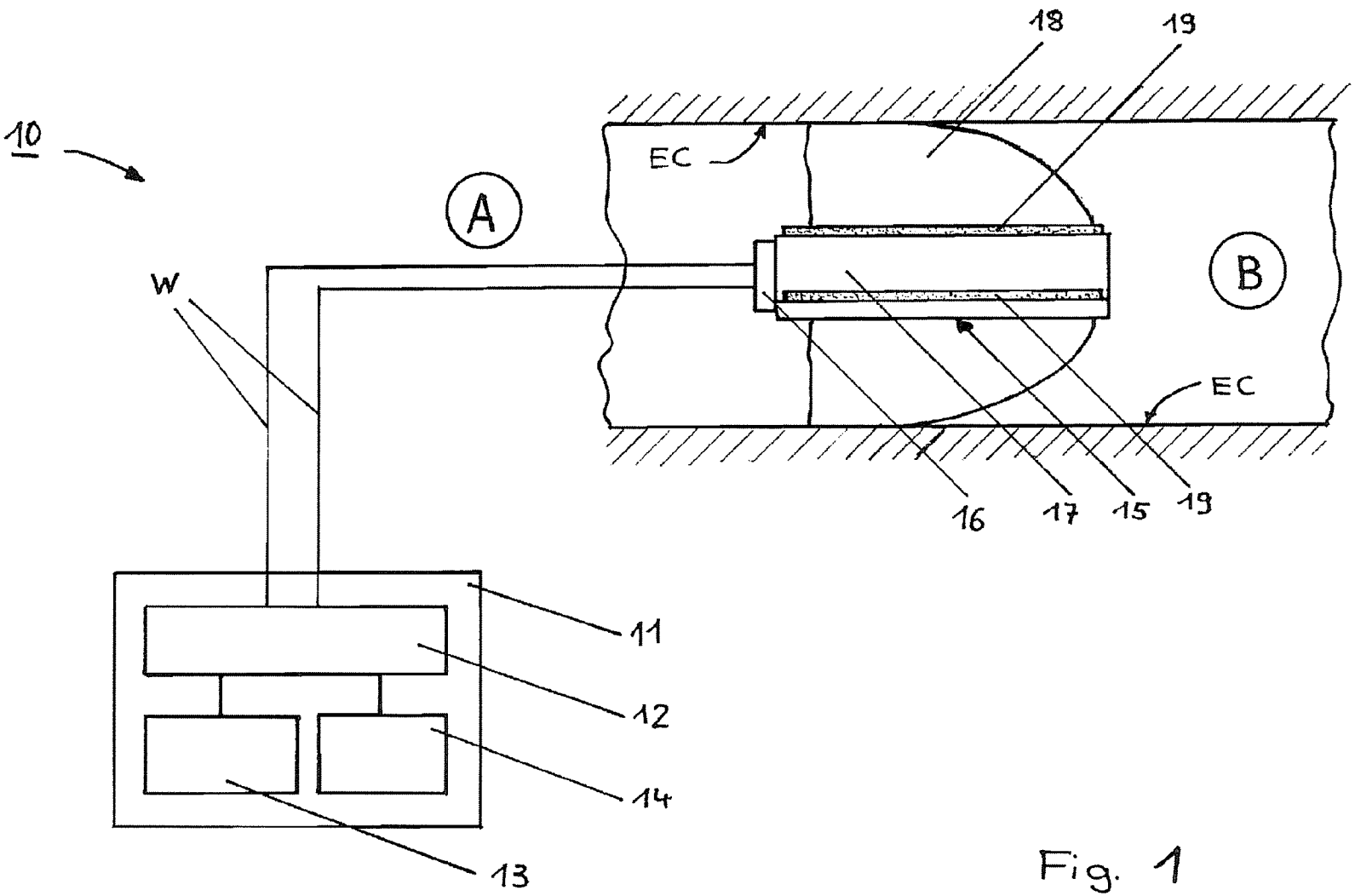
FIG. 1 an overall view of a hearing device according to a first embodiment of the present invention, FIGS. 2A and 2B an enlarged view of an output module as well as of a venting channel arrangement shown in FIG. 1, FIGS. 3A and 3B different shapes of venting channel arrangements according to the first embodiment, FIGS. 4A and 4B an enlarged view of an output module and a venting channel arrangement according to a second embodiment of the present invention, FIG. 5 a partial view of an embodiment of a hearing device part, FIG. 5A being a cross-sectional view along a longitudinal axis of the output module, FIG. 5B and FIG. 5C being two different possible cross-sectional views perpendicular to the longitudinal axis, and FIG. 6 a partial view of a further embodiment of a hearing device part.

The present invention is described in the following in conjunction with the schematic diagram of FIG. 1 showing an overall view (cross-sectional view in part) of the structure and arrangement of a hearing device 10 according to the first embodiment of the present invention. The hearing device 10 comprises three separate physical bodies, 1) circuitry unit 11, 2) mould 18 and 3) output module 15 mounted in a throughgoing opening of the mould, the circuitry unit and the output module being electrically connected. The circuitry unit 11 can e.g. form part of a module located behind the ear of a user.

According to the representation shown in FIG. 1, the hearing device 10 comprises a casing, (shell) at least enclosing electronic circuitry providing a signal processing unit of the hearing device. The electronic circuitry comprises a circuitry unit 11 comprising a central control unit 12 (controller) that controls the hearing device 10 to be worn by the user. The central control unit 12 is connected to an input unit 13 which may be a microphone (such as a directional microphone system, possibly comprising a number of differently located microphones) for picking up sound signals (sound pressure information) of any sound or noise surrounding the user. Alternatively, the input unit 13 may be a sensor for sensing an electric signal representing a sound signal picked up otherwise. The components of the circuitry unit 11, such as the central control unit 12 and the input unit 13 are powered by the power supply unit 14. The power supply unit 14 may comprise any suitable battery or rechargeable battery.

The circuitry unit 11 and in particular the central control unit 12 thereof, which serves as a controller, receives an electric input signal representing acoustic sound inputs (that is, the sound signals or sound pressure information surrounding the user) and provides a data evaluation and processing of the sound signals. The processed sound signals (in electric form) are fed to and are received by an output module 15 comprising an output transducer (receiver 16), which is connected to the central control unit 12 via an electric wiring W (here two wires are shown, but any appropriate number of wires can be used). Alternatively, such transmission can be performed via a wireless coupling, e.g. an inductive coupling between inductive coils of the circuitry unit and the output module, respectively. The transmission from one unit to the other could alternatively be by any other appropriate means, e.g. optical or acoustic.

The output module 15 is located remote (separate) from the circuitry unit 11 of the hearing device 10 as discussed above, and is—when in operation—arranged in an ear canal EC of the user.

To this end, the output module 15 is inserted into a mould 18 which can directly be inserted into the user's ear canal EC and which is adapted to fit therein (e.g. by a customized moulding process, cf. e.g. EP 1 345 470 or EP 1 295 509). The mould 18 comprising a through going opening and having inserted therein the output module 15 constitutes a component of the hearing device 10, which can be arranged remotely from the circuitry unit 11 of the hearing device 10, and the output module 15 has its only connection with the circuitry unit 11 by means of the electric wires W. The output module 15 includes a housing 17 for accommodating the receiver 16 which acts as a transducer for converting the electrical signals into sound waves or acoustic signals perceivable by the user.

The hearing device 10 according to the arrangement shown in FIG. 1 is discussed for example on the basis of a RITE hearing device (RITE=Receiver In The Ear), wherein the output module 15 (including receiver 16) is positioned in the user's ear canal EC for normal operation of the hearing device 10, whereas the circuitry unit 11 including the circuitry of the hearing device 10 as discussed above can be placed in the ear or preferably behind the ear of the user.

Regarding the regular or normal function of the hearing device, as already mentioned above, the input unit 13 picks up the surrounding sound or noise (sound signals, sound pressure), and a data evaluation is carried out in the central control unit 12 of the circuitry unit 11 for processing the picked-up sound signals to obtain suitable electrical signals (typically adapted to a specific user's needs), which allow a reproduction of the processed sound signals by the output module 15. That is, the surrounding sound or noise (sound signals) picked-up by the input unit 13 and in a suitable manner processed by the central control unit 12 are transmitted in the form of electrical signals through the electric wires W to the output module 15, the output module 15 being located in the user's ear canal EC and reproducing the sound signals delivered from the central control unit 12.

In FIG. 1 the mould 18 basically closes the user's ear canal EC and defines a closed or sealed portion or volume B in the user's ear canal EC between the mould 18 (in conjunction with the output module 15) and the user's ear drum (not shown in FIG. 1).

A portion A of the user's ear canal EC is the portion thereof which opens to the outside. This open portion A receives to a certain extent any sound or noise (sound signals, sound pressure) from the outside, i.e. the prevailing noise and sound surrounding the user. When mounted in an operational state of a user's ear canal, the mould 18 separates the open portion A and the closed portion B of the user's ear canal.

In the arrangement of the hearing device 10 as shown in FIG. 1 the elements, such as the input unit 13 and the central control unit 12 of the circuitry unit 11, the electric wires W and the output module 15 constitute an electro-acoustic signal path by means of which the regular function of the hearing device 10 is provided (optionally including the adaptation of the signal to a user's particular needs). The output module 15 represents the function of the output transducer or speaker, and the output module 15 is driven by the central control unit 12 to provide the required electro-acoustic output after a corresponding processing and amplification.

The acoustic conditions in the sealed portion B of the user's ear canal EC depend to a certain extent on the arrangement of the hearing device 10 in the user's ear canal EC and the structure thereof, and the arrangement of the mould 18 inserted in the user's ear canal EC.

In order to avoid the occlusion effect the hearing device 10 according to the present invention includes at least one venting channel 19 which is arranged on the output module 15 (in connection with an outer surface of the housing 17 of the output module such as in or on the surface of the housing 17) and/or on or in the inner surface of the through going opening of the mould in which the output module is mounted when in operation.

The cross-sectional diameter of a typical circular vent can e.g. be 1.4 mm when formed as one tubular vent in a micro-mould. A corresponding vent area can e.g. be distributed on 3 smaller vent channels, each possibly having a semi-circular or rectangular form. In case of semi-circularly shaped vents having a radius of 0.6 mm the total area of the three identical vents will be approximately equal to that of the 1.4 mm diameter single vent. The semi-circular vents could—as an alternative to one large vent running parallel to the module through the mould—be made as grooves in the outer surface of the output module (also termed the receiver module) and/or in the inner surface of the opening.

Figure 2B:
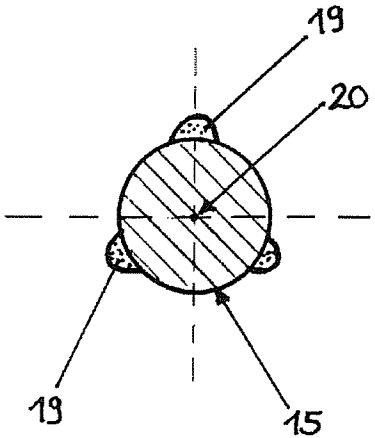
Figure 2A:
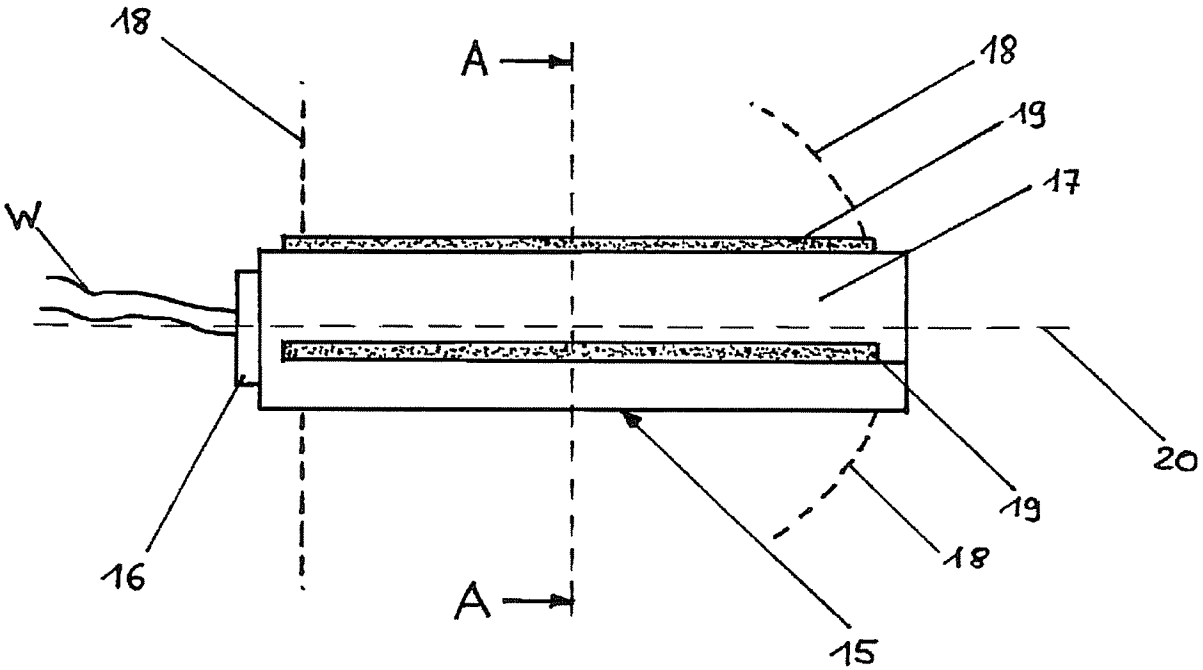

For the further description of the arrangement of the at least one venting channel 19 according to the present invention, reference is now made to FIGS. 2A and 2B.

In general, a venting volume in a hearing device according to the present invention can be conveniently arranged between the matching surfaces of the output module and the mould, e.g. mainly as grooves in one of the surfaces, the other functioning as a 'lid' or mainly as channels formed by parallel running ridges on one surface, the other functioning as a 'lid', or combinations thereof. In the present embodiment as shown in FIG. 2, the at least one venting channel 19 is arranged on the (surface of the) output module 15. More specifically, the at least one venting channel 19 extends substantially along a longitudinal axis 20 of the output module 15 (the longitudinal axis 20 being the direction in which the tube-shaped output module 15 extends, the axial direction) and is directly arranged on the output module 15, that is, on the outer surface of housing 17. The at least one venting channel 19 may be basically parallel to the longitudinal axis 20. There may also be provided a plurality of such venting channels 19 which are arranged on the output module 15 and which are basically parallel to each other and basically parallel to the longitudinal axis 20 of the output module. Alternatively, they may follow other curve forms along the axial direction, e.g. a helix form to provide a longer vent-extension path for a given length of the output module covered by the mould (e.g. to provide a larger acoustic attenuation for a given cross-sectional area of the vent).

The at least one venting channel 19 (or plurality of such venting channels 19) constitutes a hollow channel or duct which provides a connection between the sealed portion B of the user's ear canal EC and the open portion A thereof and provides a necessary balance of pressure to reduce the occurrence of the undesired occlusion effect. That is, ventilation is possible through the at least one venting channel 19 (duct) or the plurality of venting channels 19 which are arranged on the output module 15 and which also run through the mould 18 in which the output module 15 together with the at least one venting channel 19 is inserted.

FIG. 2B shows a cross-sectional view of the housing 17 accommodating the output module and being provided with the at least one venting channel 19 along the line A-A shown in FIG. 2A. The mould 18 in which the output module is inserted is not shown in FIG. 2B, but is anticipated to have an opening whose cross-section match that of the output module (at least over a part of its longitudinal extension) to provide a fitting match, when the output module is inserted in the mould, which allows the venting of the closed part (B in FIG. 1) of the ear canal to be controlled by the venting channels 19. The channel(s) 19, may alternatively (or additionally) be formed by grooves in the inner surface of the opening of the mould. This has the advantage that a substantially smooth (e.g. circular) periphery of housing 17 of the output module can be used to 'close' the groove(s) in the inner surface and to thereby form the vent channel(s) 19.

The arrangement of FIG. 2B shows that the plurality of venting channels 19 (for example as here three venting channels 19) may basically be evenly distributed on the circumference of the output module 15. The plural venting channels 19 are here arranged on the output module 15 (outer surface 17 thereof) to extend along the longitudinal axis 20.

The at least one venting channel 19 or the plural venting channels 19 as outlined in FIG. 2B together represent the effect of one single bigger venting channel. That is, the plural venting channels 19 according to the first embodiment of the present invention, each having a smaller effective diameter than one bigger venting channel, are e.g. arranged such that the combination of the plural venting channels 19 basically provide an effective diameter corresponding to one bigger venting channel according to the references above but the plural venting channels 19 do not provide the disadvantages of one single bigger venting channel. In an embodiment, a predefined cross-sectional area A of a venting channel is distributed on a number n of separate venting channels together having the predefined cross-sectional area (A=SUM ($a_i$), where A is the predefined area and $a_i$ is the area of the $i^{th}$ separate vent and SUM is a summation over the i=1, 2, . . . , n separate vents).

For inserting the output module 15 in conjunction with the at least one venting channel 19 or the plural venting channels 19 a corresponding opening is to be made in the mould 18 so that the combination of the output module 15 and the plural venting channels 19 will properly and tightly fit to this specific opening in the mould 18. The shape of the opening in the mould 18 may have the shape of the arrangement of the output module 15 and the venting channels 19 according to FIG. 2B (or the venting channels may 15 simply be constituted by channels or grooves in the inner surface of the mould and emerge as such when the output module is properly located in the mould opening). Moreover, the axial length $L_{vent}(z)$ of the venting channels 19 is (in the present embodiment) shorter than the axial length $L_{module}(z)$ of the output module 15 in its longitudinal direction, z. On the other hand, the axial length $L_{vent}(z)$ of the venting channels 19 is (in the present embodiment) longer than the length of the fitting opening of the mould $L_{mould}(z)$, so that a ventilation of the closed volume (B in FIG. 1) can be achieved when the output module is mounted in the mould and the mould is mounted in its operational location in the ear canal of a user.

The mould is typically made of a form stable plastic material by an injection moulding process or formed by a rapid prototyping process, e.g. a numerically controlled laser cutting process (see e.g. EP 1 295 509 and references therein).

The porous filter material is chosen to preferably have an acoustically damping effect at relatively higher frequencies (e.g. f>2 kHz). The porous filter material may additionally attenuate unintentional longitudinal vent resonances at even higher frequencies (e.g. f>8 kHz). In an embodiment, the filter material is a sintered plastic material. In an embodiment, the filter material is a composite material, e.g. comprising a matrix of fibres. In an embodiment, the filter material is an open pore polyethylene. In an embodiment, the filter material is a foam ceramic. Various appropriate porous materials are described in U.S. Pat. No. 6,574,343 and references therein.

For explanation purposes according to the first embodiment of the present invention FIGS. 2A and 2B show the provision of three venting channels 19, each having a relatively small effective diameter (small cross-sectional area), but the present invention is not limited to this particular number of venting channels 19. Depending upon the acoustic properties of the hearing device 10 to be adapted to the user's ear canal EC, a smaller or higher number of venting channels 19 can be used. That is, any other suitable number of venting channels necessary for obtaining the desired adaptation of the hearing device 10 to the user's acoustical and medical needs can be implemented. For example, four or more very small venting channels 19 can be arranged preferably basically in parallel to the longitudinal axis 20 of the output module 15 and can be distributed in a predetermined manner along the circumferential direction of the output module 15.

In FIGS. 2A and 2B the plural venting channels 19 are preferably evenly distributed in the circumferential direction of the housing 17. The present invention is, however, not limited to such a distribution of the plural venting channels 19, but any further suitable predetermined distribution with symmetry or not can be provided. The determination of an arrangement of the plural venting channels 19 departing from the basically symmetric arrangement shown in FIG. 2B as well as the determination of a suitable number of venting channels 19 having the smaller effective diameter depend upon the conditions for adapting the hearing device 10 to the hearing loss of the user (amplification), the structure of the user's ear canal EC and the user's preferences.

The arrangement of the venting channels 19 as shown in FIGS. 2A and 2B at a boundary between the output module 15 and the mould 18 provide a replacement of a conventional bigger venting channel with a number of (plural) venting channels (duct, opening) along the boundary between the output module 15 and the mould 18. The necessary effective diameter of the plural venting channels 19 provides a distribution of the necessary space (corresponding opening in the mould 18) which is advantageous in comparison to the provision of one single conventional venting channel which occupies rather much space at one side of the output module 15.

Figure 3B:
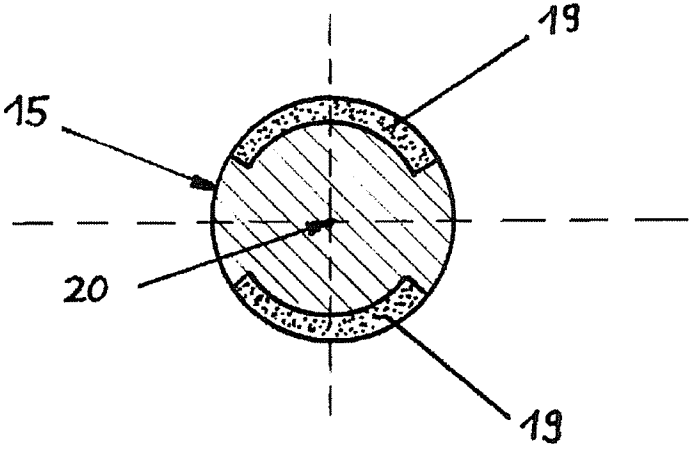
Figure 3A:
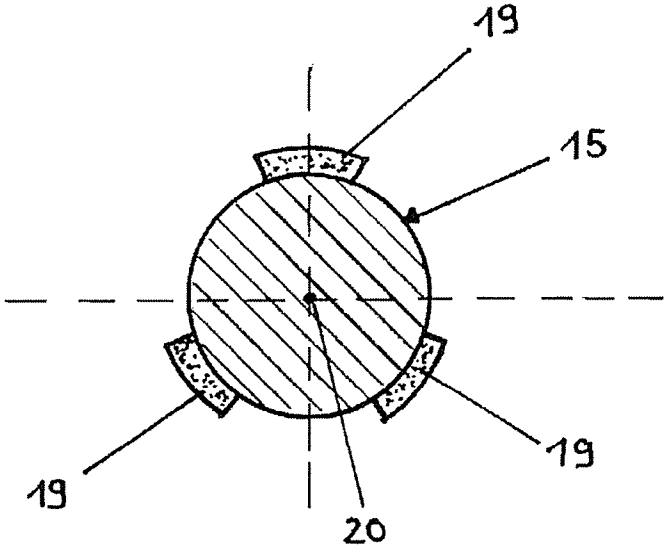

A different shape, arrangement and positioning of particular venting channels 19 is shown in FIGS. 3A and 3B.

In FIG. 3A which basically represents a cross-sectional view according to line A-A of FIG. 2A there is shown an arrangement of, for example, three particular venting channels 19 which have a more flat outer shape and are positioned in a similar manner as the plural venting channels 19 shown in FIG. 2B. The shape of the venting channels 19 according to FIG. 3A which protrude from the outer surface of the output module 15 requires a corresponding opening in the mould 18 (not shown in FIGS. 3A and 3B) so that the combination of the venting channels 19 and the output module 15 can properly be inserted into and fit in the mould 18.

The present invention is of course not limited to the shape, the number and the location (distribution) of the venting channels 19 to the arrangement of FIG. 3A, and a smaller or higher number of venting channels 19 can be used with a distribution different from the (preferably even) distribution shown in FIG. 3A, and also the venting channels 19 may have a different outer shape.

In a similar manner as it is the case in FIG. 2A, the venting channels basically extend along the outer surface of the output module 15, and basically parallel to the longitudinal axis 20 thereof.

The channel(s) 19 may further, alternatively (or additionally), be formed by grooves in the inner surface of the opening of the mould.

A further development of the present invention and specifically of the arrangement and shape of the venting channels 19 is shown in FIG. 3B. In this case as represented in FIG. 3B the plural venting channels 19 are provided in and are formed by a grooved or recessed portion of the output module 15, and extend in parallel to the output module 15. The arrangement shown in FIG. 3B therefore provides an outer appearance or shape of the housing 17 of the output module 15 which has no protruding portions since the plural venting channels 19 can be embedded within the circular shape (cross-sectional area) of the output module 15.

As an opening in the mould 18 for inserting the output module 15 and for fixing the output module 15 to the mould 18 a simple circular opening is necessary. This may facilitate manufacturing of the mould 18.

The present invention is however not limited to the example of an arrangement of the venting channels 19 on the output module 15 as shown in FIG. 3B. Also in this case the number of venting channels 19 can be modified and the positioning or distribution of the venting channels 19 on the circumferential surface of the output module 15 is not limited to the situation shown in FIG. 3B and also not limited to symmetry. That is, a higher number of venting channels can be implemented, the venting channels basically extending along the longitudinal axis 20 of the output module 15. Further, other shapes and/or cross-sectional areas of the vent channels can be provided according to the requirements of the particular case.

According to a modification of the first embodiment of the present invention a combination of the arrangement shown in FIGS. 3A and 3B is possible resulting in the provision of plural venting channels 19 on the outer surface of the output module 15, one or more vent channels protruding to a certain extent from this outer surface and one or more vent channels being arranged in a corresponding recessed portion of the output module 15.

In the foregoing description it was mentioned that the at least one venting channel 19 or plural venting channels 19 are provided in the form of openings or ducts to allow ventilation and specifically a balance of pressure to raise the comfort of the user of the hearing device 10 and to reduce the uncomfortable occlusion effect. Hence, the at least one venting channel 19 allows the passing of air. If individual venting channels are very narrow, useful thermodynamic losses will be created, but such narrow channels may have difficulties in a manufacturing process.

According to a further modification of the first embodiment of the present invention the at least one venting channel 19 may be provided with a porous material (21 in FIG. 4) which is arranged or inserted in the at least one venting channel 19. That is, the at least one venting channel 19 is at least partly (or possibly completely) filled with the porous material, such as e.g. a fibre based material or a sintered plastic or an open pore polyethylene, this porous material still allowing the penetration of air to provide the intended balance of pressure when being inserted in the user's ear canal EC (FIG. 1).

In at least one of the plurality of venting channels 19 the porous material may be inserted to fill this particular venting channel 19 partly or completely with the porous material. Alternatively, more than one of the plurality of venting channels 19 or all the venting channels 19 may be provided with the porous material at least partly or completely.

The provision of the porous material inside the at least one venting channel 19 or in some or all of the plurality of venting channels 19 preferably leads to a predetermined attenuation of the high frequency transmission through the venting channel due to thermodynamic losses and/or due to transmission losses when the sound travels from the sealed portion B through at least one venting channel 19 being at least partly or completely filled with the porous material to the outside (open, not sealed) region A. The porous insert is preferably selected to provide a predetermined attenuation of sound. In more detail, primarily the highest frequencies of the sound (high frequency components thereof) transmitted through the at least one venting channel 19 are preferably attenuated and the feedback margin for these frequency components thereby increased. That is, the possibility of causing a feedback condition based on higher frequency components is considerably reduced.

Moreover, a better feedback margin for a given size of the at least one venting channel 19 is obtained due to the fact that the openings of the at least one venting channel 19 are located very close to the output portion of the output module 15 (receiver) since the at least one venting channel or the plural venting channels are arranged on the outer surface of the output module 15. This has a positive effect on the feedback margin at mid-range frequencies or frequency components. The exact improvement depends on the size of the residual sealed portion B (cavity) of the user's ear canal EC.

The porous material provided to at least one of the plural venting channels 19 (partly or completely) is preferably inserted in a replaceable manner.

The arrangement according to an aspect of the invention of at least one venting channel 19 or a plurality of venting channels 19 each having a relatively small cross-sectional area makes it possible to insert the output module 15 into a small mould (micro mould) having relatively small dimensions (e.g. in the mm-range e.g. cross-sectional dimensions of 5 mm in diameter and a length of 7 mm in an axial direction). The bore in a mould (for example a micro mould) of a conventional hearing aid for inserting the single bigger venting channel occupies much space (e.g. a diameter of 1.4 mm). Due to the geometrical advantages based on the plurality of smaller venting channels 19 and resulting from the absence of one single large venting channel, deeper fittings are possible. This increases comfort of the user wearing the hearing aid 10. As described above, the venting channels 19 according to the present invention can be provided by removing material from the output module 15 and/or from the mould 18 (e.g. by forming channels or grooves in the respective surfaces).

The smaller size of the output module 15 and including the plurality of venting channels 19 leads to a compact and space-saving arrangement. The insertion of the porous material 21 into the venting channels 19 leads to the possibility of providing a venting channel with a certain cross-sectional area without sacrificing the feedback margin. The division of the effective cross-sectional area into the plurality of venting channels each having a smaller cross-sectional area provides an effective reduction of the undesired occlusion effect while the occurrence of any feedback condition is prevented.

Second Embodiment

Based on the representation of FIGS. 4A and 4B a second embodiment of the present invention is described in the following.

Figure 4B:
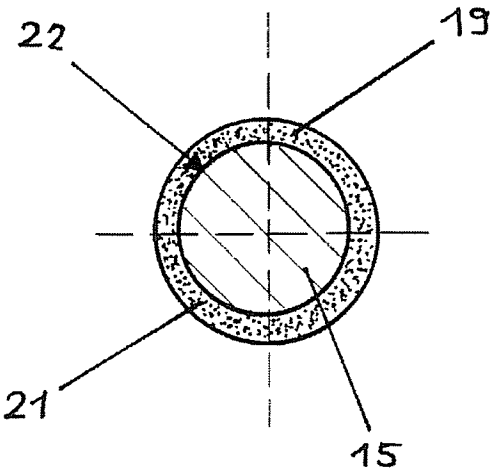
Figure 4A:
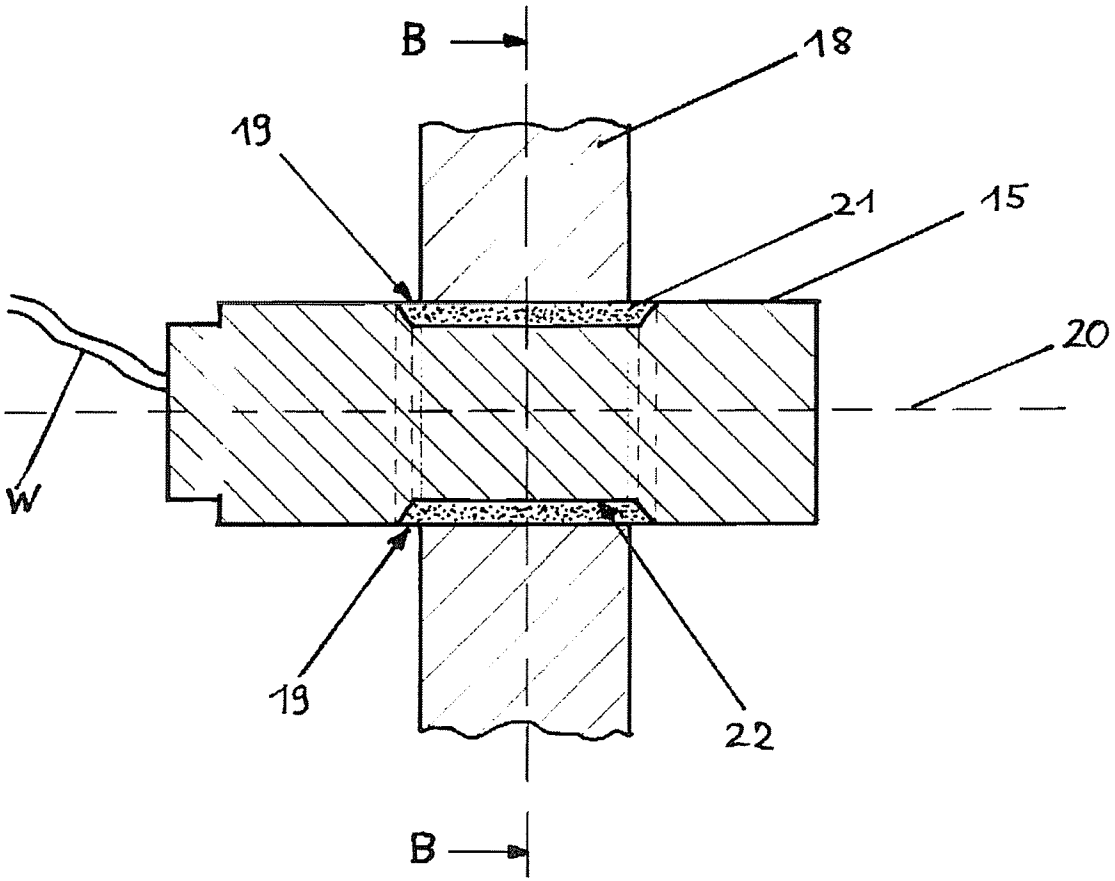

Elements and means shown in FIGS. 4A and 4B which have already been described in conjunction with the first embodiment and which are shown in any of the preceding Figures (FIGS. 1 to 3) and which have the same function are provided with the same reference number, and a further detailed explanation thereof is omitted.

FIG. 4A, which is a cross-sectional view, shows the arrangement of an output module 15 in a mould 18, the output module including a housing 17 in which a receiver is accommodated. Electric wires W provide a connection of the output module to a circuitry unit 11 (not shown in FIG. 4, see FIG. 1). The circuitry unit 11 according to the second embodiment has the same function as that of the first embodiment, and a further description is therefore omitted.

FIG. 4A further shows that the output module 15 is inserted into a portion (wall) of a mould 18. That is, the mould 18 is provided with an opening for inserting the housing 17 of the output module 15 so that the output module 15 can be supported by the mould 18. Preferably, the output module 15 has a cylindrical shape and extends along a longitudinal axis 20 (axial direction). Moreover, the length of the venting channel 19 in the direction of the longitudinal axis 20 of the output module 15 is greater than the thickness (in a longitudinal direction of the output module) of the mould 18 at the position where the output module 15 is inserted. Alternatively or additionally, the inner surface of the opening of the mould 18 may comprise a channel, e.g. a corresponding indentation or recess (optionally comprising a porous material 21), overlapping with that of the output module in a longitudinal direction, so that a larger surface of contact between output module and mould is provided. In an embodiment, the mould comprises a further wall-like portion and the output module comprises a corresponding further opening or recess along its the longitudinal extension arranged so that they together form a further vent channel, when the output module is properly mounted in the mould. In an embodiment, the opening or recess in the outer surface of the output module is not present along the full periphery of the surface, to allow the wall-like portion(s) of the mould to have some support on the (unindented parts of the) surface of the output module (e.g. in case the vent channel contains no acoustically attenuating filler material).

Furthermore, basically at the circumferential surface of the output module 15 facing the opening in the mould 18 a porous material 21 is arranged. More specifically, at the portion of the output module 15 facing the mould 18 a recessed portion 22 such as a groove is provided for accommodating a layer of a porous material 21. The recessed portion 22 extends in the circumferential direction around the output module 15, and the layer of the porous material 21 is accommodated in the recessed portion and also extends in the circumferential direction around the output module 15.

FIG. 4B shows a cross-sectional view along the line B-B shown in FIG. 4A. The inner circle of the structure shown in FIG. 4B represents the output module 15 and having the recessed portion which results in a reduced diameter of the output module 15. At the outer side of the recessed portion, that is, in the circumferential direction of the recessed portion 22 the layer of the porous material 21 is arranged and represented in FIG. 4B as an annular portion in a range between the reduced diameter of the output module 15 and basically the maximum diameter thereof.

As can be seen from the context of FIG. 4A, the layer of the porous material 21 arranged on the recessed portion 22 of the output module 15 is adjacent to the inner surface of the opening in the mould 18, and the recessed portion 22 filled with the porous material 21 between the output module 15 and the mould 18 constitutes a venting channel 19 defined between the output module 15 and the mould 18 (opening).

In more detail, the venting channel 19 defined by the recessed portion 22 has a ring-shaped cross-sectional area based on a small difference between the outer diameter of the output module 15 and the smaller diameter of the output module 15 at the recessed portion 22. The space (cross-sectional area) of the venting channel according to FIGS. 4A and 4B is completely filled with the porous material 21 and forms the venting channel 19 defined at the interface between the output module 15 and the mould 18. That is, in the case of the arrangement according to the second embodiment of the present invention the porous material preferably has a rigidity which allows a tight fit to the mould 18.

The present invention is however not limited to a complete filling of the recessed portion 22 of the output module 15 with the porous material 21, and this porous material 21 can also be inserted in or accommodated by the recessed portion in part, resulting in the arrangement of the porous material 21 in predetermined parts of the recessed portion 22. Alternatively, the recessed portion can be void of any filling material (other than air).

Moreover, the present invention is not limited to a ring-shaped cross-sectional area of the venting channel 19 defined according to FIGS. 4A and 4B between the output module 15 and the opening of the mould 18. Hence, any suitable cross-sectional area of the output module 15 accommodating the receiver 16 and of the form and shape of the recessed portion 22 can be implemented, resulting in a corresponding opening in the mould 18 so that the recessed portion, possibly including partly or completely the porous material 21, properly fits into the opening of the mould 18. One alternative is e.g. a helical groove in the outer surface of the output module allowing air to propagate from the enclosed volume to the outside. The groove can likewise be filled with a material to control its acoustic propagation properties.

The preferably ring-shaped venting channel 19 according to the second embodiment shown in FIGS. 4A and 4B extends along a longitudinal axis 20 of the output module 15.

The venting channel 19 defined between the output module 15 and the mould 18 on the basis of a recessed portion 22 in the output module 15 provides the same advantages as the arrangement of a plurality of venting channels 19 according to the first embodiment of the present invention.

The porous material 21 has a filtering function. The porous material 21 can be replaced when the output module 15 is removed from the mould 18 for maintenance purposes. Due to the fact that the dimensions of the output module 15 can be kept small despite the fact that an effective venting channel 19 is provided, the output module 15 (including the receiver 16) can be inserted in a small mould 18, such as a micro mould. The porous material (porous filter, porous layer) which is inserted in a recessed portion around the receiver module (at the outer surface of the housing 17) is therefore useful for obtaining high frequency attenuation in a predetermined manner.

Figure 5A:
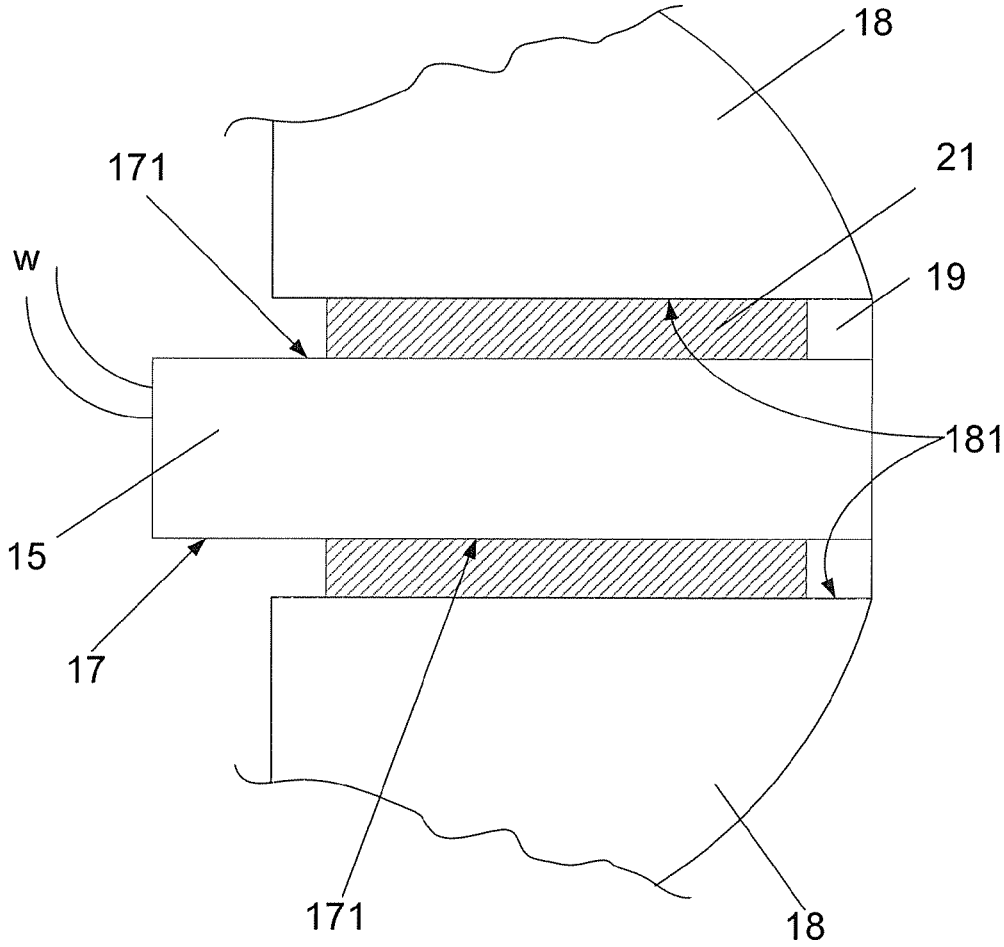
Figure 5B:
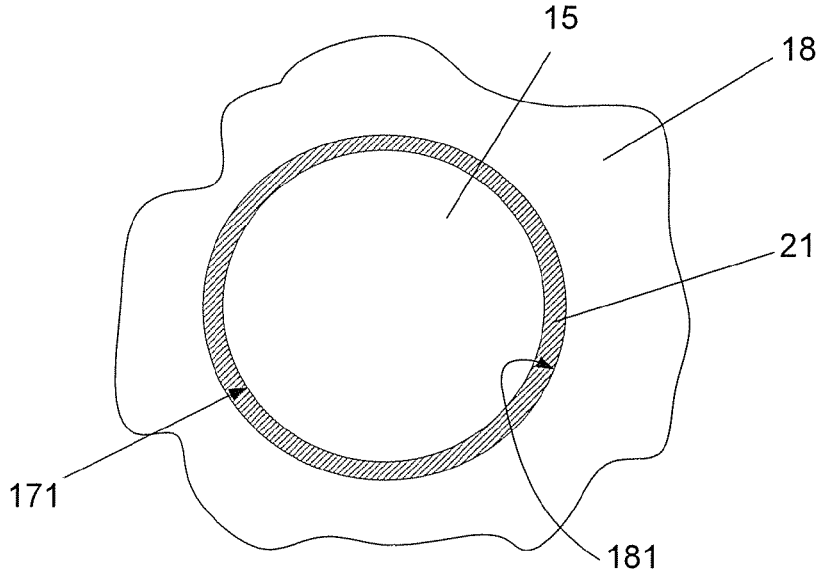
Figure 5C:
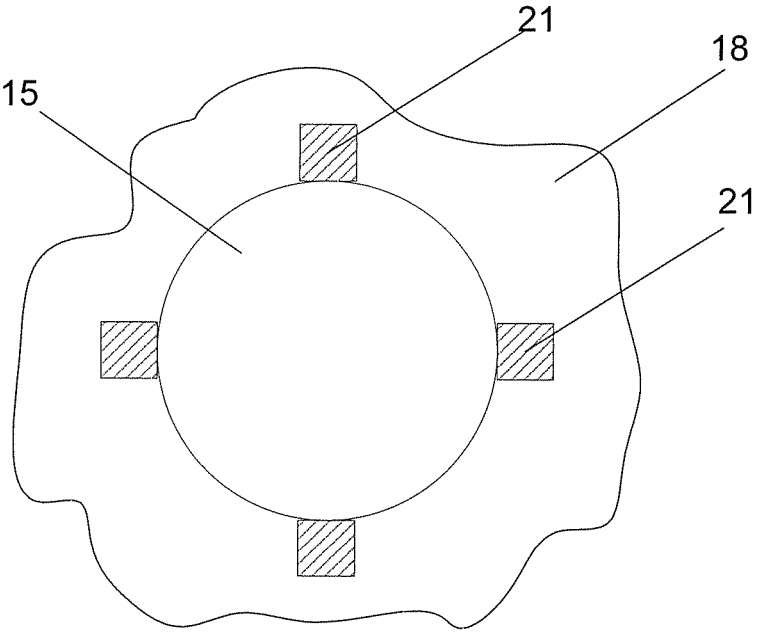

FIG. 5 shows a partial view of an embodiment of a hearing device part according to the present invention comprising an output module 15 fittingly inserted in a through going opening of a mould 18. In the embodiment of FIG. 5A, a layer of an appropriate filler material 21, e.g. a porous material, is applied to the outer surface 171 of the housing 17 of the output module 15 over a part of its longitudinal extension (instead of being embedded in a recess in the surface as in FIG. 4A), thereby providing a convenient mechanical solution with a tight fit between the filler material 21 of the vent 19 channel and the inner surface 181 of the opening of the mould 18 (which is only partially shown). FIG. 5A shows a cross-sectional view along a longitudinal axis of the output module. FIG. 5B and FIG. 5C shows two different possible cross-sectional views perpendicular to the longitudinal axis. FIG. 5B illustrates an embodiment comprising a ring-formed layer of filler material 21. FIG. 5C illustrates an embodiment comprising 4 rectangular ridges comprising filler material 21 and symmetrically located around the periphery of the housing 17 of the output module 15, the module being located in a mould 18 having a correspondingly matching opening cross section.

Figure 6:
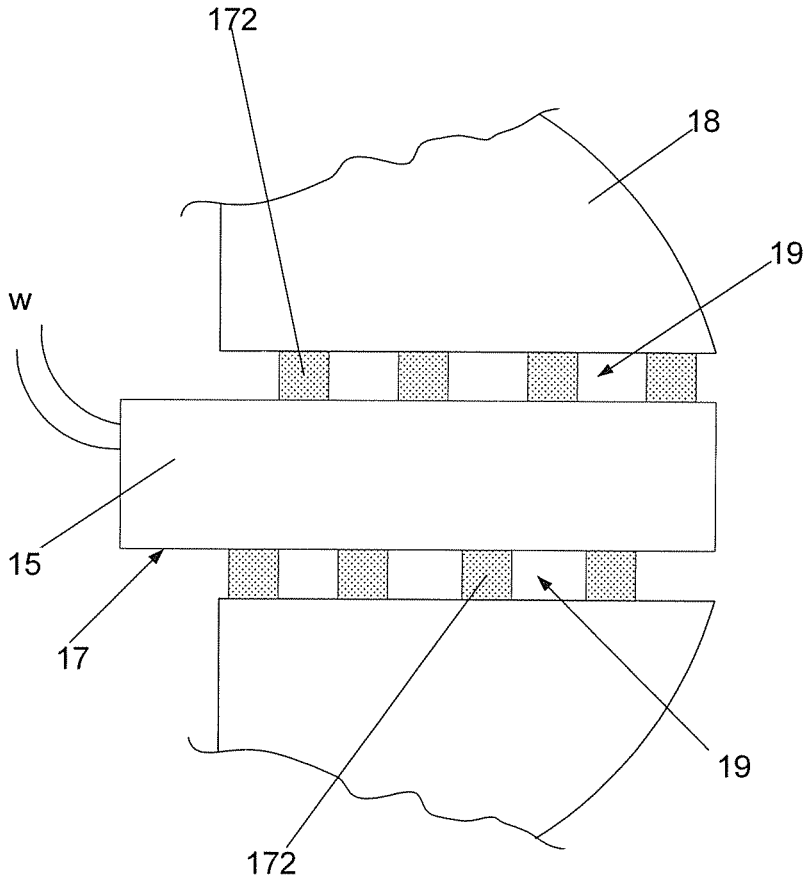

FIG. 6 shows a partial view of an embodiment of a hearing device part according to the present invention comprising an output module 15 fittingly inserted in a through going opening of a mould 18. A helical ridge 172 is arranged on the outer surface of the enclosure 17 of the output module so that a helical vent channel 19 is thereby formed. The vent channel may in an embodiment be filled with a filler material 21 at least over a part of its length (e.g. at an end of the vent channel, e.g. at the end facing the outer environment (volume A in FIG. 1), or alternatively at the end facing the enclosed volume (B in FIG. 1), or both).

It is to be noted that the Figures described above do not represent real proportions but only provide a schematic view which is helpful for explanation and understanding of the subject matter of the present invention explained above on the basis of embodiments and modifications thereof. Moreover, the present invention has been illustrated and described in detail by means of the foregoing description in conjunction with the drawings, and such illustrations and descriptions are to be considered illustrative or exemplary and not restrictive.

The subject matter of the present invention is not limited to the embodiments as described above, and even reference numbers shown in the drawings and referred to in the description and the claims do not limit the scope of the present invention. It is considered that all technical means and equivalent elements or components are included in the present invention and are considered to form part of the scope of the present invention as defined by the appended claims.

The invention claimed is:

1. Hearing device, comprising:

an input unit adapted for generating electric signals representing sound signals, a control unit connected to the input unit and being adapted for processing the electric signals, an output module comprising an output transducer that is connected to said control unit, wherein said output module defines an outer surface, and a mould, wherein said output module is mounted in an opening of said mould, wherein the mould is arranged to have an opening with an inner surface, wherein the dimensions and form of the outer surface of the output module, the opening and the inner surface of the mould are adapted to allow the output module to be mounted in the opening at least over a part of their common spatial extension, wherein a plurality of venting channels are arranged around the output module extending along a longitudinal axis thereof, said plurality of venting channels being arranged between said mould and an outer surface of said output module, said plurality of venting channels being formed by a ridge or channel extending along the outer surface of the output module and/or of the inner surface of the mould.

2. The hearing device according to claim 1, wherein the axial length of said at least one venting channel is shorter than the axial length of said output module.

3. The hearing device according to claim 1, further including a plurality of venting channels, wherein said plurality of venting channels are evenly distributed on the surface of the output module in the circumferential direction thereof.

4. The hearing device according to claim 1, wherein said at least one venting channel comprises a recessed portion of said output module extending in the circumferential direction of said surface of said output module.

5. The hearing device according to claim 1, wherein a length of said at least one venting channel in a longitudinal axis of said output module is greater than the thickness in said longitudinal direction of the mould into which the output module is inserted.

6. The hearing device according to claim 1, wherein said at least one venting channel is at least partly filled with a material for controlling the acoustic propagation properties of the venting channel.

7. The hearing device according to claim 6, wherein said material is a porous material that is replaceably inserted in said at least one venting channel.

8. The hearing device according to claim 1 wherein at least a part of a closed outer surface of the output module forms a longitudinal body or a longitudinal member of a body, at least a part of which being adapted for being mounted in an opening of a mould.

9. The hearing device according to claim 1 wherein the output module is constituted by a longitudinal body, such as a cylindrical body or a conical body.

10. The hearing device according to claim 1 wherein one or more venting channels is/are arranged between the outer surface of the output module and the inner surface of the mould by arranging one or more ridges in one of or both surfaces, the one or more ridges having a component of extension in an axial direction of the output module.

11. The hearing device according to claim 1 wherein a ridge or channel extends along the outer surface of the output module and/or the inner surface of the mould along a straight line or a helix.

12. The hearing device according to claim 1 wherein localized protrusions from a surface are arranged to fully or partially fix the output module in the opening of the mould and at the same time allow a certain ventilation.

13. The hearing device according to claim 1, further comprising a) a NITE-part adapted to be located at or behind the ear or other places on the body, and b) an ITE-part of a hearing device comprising b1) a mould for being inserted in a user's ear canal and b2) the output module, the output module comprising a receiver for providing an acoustic output and being enclosed in a housing having an outer surface, wherein the mould is arranged to have an opening with an inner surface, and wherein the dimensions and form of the outer surface of the output module housing, the opening and the inner surface of the mould are adapted to allow the output module housing to be mounted in the opening, at least over a part of their common spatial extension, and wherein at least one venting channel is arranged between the inner surface of the mould and an outer surface of the output module housing, the ITE-part being adapted for being at least partially located in the ear canal of a user while the input unit and the control unit are located in the NITE-part.

14. The hearing device according to claim 1, wherein the cross-sectional shape of an individual venting channel has a rectangular or elliptical or triangular form.

15. The hearing device according to claim 1, wherein the cross-sectional form and/or area changes along the length of a vent.

16. The hearing device according to claim 15, wherein the cross-sectional form and/or area of a vent increasing from one end to the other.

17. The hearing device according to claim 15, wherein the vent has a larger cross-sectional area at the end facing the enclosed volume than at the end facing the outside when the device is mounted in an ear canal of a user.

18. The hearing device according to claim 1, wherein the output module is tightly fit into the opening of the mould so that the exchange of air from the enclosed volume between the mould and the output module, when properly inserted into the opening of the mould, and the outside environment is controlled by the plurality of venting channels.

19. Hearing device according to claim 6, wherein a layer of the filler material is applied to the outer surface of the housing of the output module at least over a part of its longitudinal extension.

20. The hearing device according to claim 1 wherein the only electronic component contained in the output module is the receiver.

21. The hearing device according to claim 1 wherein the only electronic component contained in the output module is a wireless receiver comprising: an amplifier of the received signal to adapt its level to the receiver; and the receiver.

22. The hearing device according to claim 1 wherein the output module further comprises a microphone.

23. The hearing device according to claim 1 wherein the output module further comprises the control unit.

24. The hearing device according to claim 1 wherein the output module further comprises a battery.

25. The hearing device according to claim 1 wherein all normal electronic functions of a hearing aid are included in the output module, including an anti-feedback system.

26. The hearing device according to claim 1 wherein the input unit and the control unit are located in the mould.

* * * * *